United States Patent [19]

Yoshiba

[11] Patent Number: 4,816,815

[45] Date of Patent: Mar. 28, 1989

[54] DISPLAY MEMORY CONTROL SYSTEM

[75] Inventor: Yutaka Yoshiba, Tokyo, Japan

[73] Assignee: Ricoh Company, Ltd., Tokyo, Japan

[21] Appl. No.: 40,720

[22] Filed: Apr. 20, 1987

Related U.S. Application Data

[63] Continuation of Ser. No. 690,615, Jan. 11, 1985, abandoned.

[30] Foreign Application Priority Data

Jan. 28, 1984 [JP] Japan ..... 59-12831

[51] Int. Cl.[4] ..... G09G 1/00

[52] U.S. Cl. ..... 340/750; 340/799; 340/801

[58] Field of Search ..... 340/750, 799, 721, 724, 340/798, 801

[56] References Cited

U.S. PATENT DOCUMENTS

| | | | |
|---|---|---|---|
| 4,200,869 | 4/1980 | Marayama et al. | 340/750 |
| 4,232,376 | 11/1980 | Dion et al. | 340/750 |
| 4,325,063 | 4/1982 | Herman | 340/750 |
| 4,414,628 | 11/1983 | Ahuja et al. | 340/721 |
| 4,482,979 | 11/1984 | May | 340/750 |
| 4,663,735 | 5/1987 | Novak et al. | 340/750 |
| 4,688,190 | 4/1987 | Bechtolsheim | 340/750 |

*Primary Examiner*—Gerald L. Brigance
*Assistant Examiner*—Mahmound Fatahi-Yar
*Attorney, Agent, or Firm*—Oblon, Fisher, Spivak, McClelland & Maier

[57] ABSTRACT

A display memory control system is disclosed which is associated with a display system for displaying and outputting character data, graphic data and the like. In the event of displaying images on a display, a system (host computer) writes one screen of display data in one of two VRAMs. The display data are transferred to the display and to the other VRAM to be stored therein. Upon completion of the storage in the other VRAM, the display data stored therein are read out to appear on the display. To update the display data, the system makes a write access to the one VRAM within a period of time other than one for which the transfer of video data is effected from the one VRAM to the other VRAM. This increases the period of time within which the one VRAM is accessible by the system and, thereby, enhances high speed data processing and display of high resolution images on the display with a desirable quality.

6 Claims, 9 Drawing Sheets

DISPLAY MEMORY CONTROL SYSTEM

This application is a continuation of application Ser. No. 690,615, filed on Jan. 11, 1985, now abandoned.

BACKGROUND OF THE INVENTION

The present invention relates to a display memory control system and, more particularly, to a display memory control system of the type wherein video data are developed in a display memory on a bit map basis.

In a display system for displaying with the bit map principle such images as characters and graphs on a cathode ray tube (CRT) or like display unit which requires refreshing, pixel data associated with all pixels which define a display screen are developed in a display memory. Generally, a display memory is implemented by a random access memory (RAM).

An increase in the resolution of displayed images is accompanied by an increase in the time necessary for developing all the video data in the display memory, which is proportional to the square of a resolution. Meanwhile, in order to preserve a predetermined image quality free from flickering, it is desirable that a write access to the display memory be effected within a period of time other than one for reading out video data into the display unit.

Concerning the management of the display memory (video RAM or VRAM), a predominant system is managing it by means of a display controller (CRT controller) independently of a control of a system (host computer). In this kind of system, video data is written in the display memory within those periods of time which are not part of the display of video signals, i.e., during the fly-back and blanking periods as distinguished from effective display periods. Due to such a limitation imposed on the write period, the time necessary for developing one screen of video data increases with the image quality designed for a system. While a write access may be effected by an interrupt during a display period in an attempt to shorten the development time concerned, such will cause the display to flicker resulting in poor display quality.

One of approaches heretofore proposed for overcoming the above-discussed dilemmatic situation is disclosed in Japanese Patent Publication No. 58-36782/1983. The disclosed approach consists in dividing a display period assigned to one pixel into two subcycles to that video data may be read out of a display memory by one of the subcycles and written therein by the other. At the current stage of development, however, such an approach is impractical from the hardware standpoint because in systems which require high resolutions use has to be made of circuit elements capable of behaving at very high speeds.

A bit map system is capable of handling both characters and graphs and, therefore, advantageously applicable to the display of images which include them in mixture. However, the state of the art allows only RAMs whose addressable areas are not greater than the order of 128K bytes to be used as a display memory and, for this reason, has not accomplished a system which can handle various different modes other than the character/graph mixture mode by use of a single VRAM chip. Although various modes may be realized by means of a plurality of VRAM chips, the address compution which covers a plurality of areas at a time would fall in intricacy and consume a longer period of time.

SUMMARY OF THE INVENTION

It is therefore an object of the present invention to provide a display memory control system which is capable of producing high resolution images on a display unit with a desirable quality.

It is another object of the present invention to provide a generally improved display memory control system.

In one aspect of the present invention, there is provided a display memory control system for a display system which includes a display unit for displaying images, comprising a control for controlling the display unit responsive to a command from a host machine, a first memory accessible by the host machine for storing display data to be displayed on the display unit, and a second memory provided in the control for storing display data. The control is constructed to control the first and second memories such that, in response to a command from the host machine commanding display of an image, display data stored in the first memory are transferred to the display unit to be displayed thereon and to the second memory to be stored therein and, during the transfer of the display data from the first memory to the display unit and the second memory, inhibition of access to the first memory by the host machine is notified to the host machine and, after the transfer of the display data to the second memory, the display data stored in the second memory are read out and transferred to the display unit to be displayed thereon.

In another aspect of the present invention, there is provided a display memory control system for a display system which includes a display unit for displaying images, comprising a control for controlling the display unit responsive to a command from a host machine, a first memory accessible by the host machine for storing display data to be displayed on the display unit, and a second memory provided in the control for storing display data. The control is constructed to control the first and second memories such that, in response to a command from the host machine commanding display of an image and a command from the host machine specifying that part of display data stored in the first memory which has been updated by the host machine, display data in the updated part is transferred from the first memory to the display unit to be displayed thereon and to the second memory to be stored therein, while display data in parts other than the updated part are transferred from the second memory to the display unit to be displayed thereon and, during the transfer of the display data from the first memory to the display unit and the second memory, inhibition of access to the first memory by the host machine is notified to the host machine and, after the transfer of the display data to the second memory, the display data stored in the second memory are read out and transferred to the display unit to be displayed thereon.

In accordance with the present invention, a display memory control system is disclosed which is associated with a display system for displaying and outputting character data, graphic data and the likd. In the event of displaying images on a display, a system (host computer) writes one screen of display data in one of two VRAMs. The display data are transferred to the display and to the other VRAM to be stored therein. Upon completion of the storage in the other VRAM, the display data stored therein are read out to appear on the display. To update the display data, the system makes a write access to the one VRAM within a period of time other than one for which the transfer of video data is effected from the one VRAM to the other VRAM. This increases the period of time within which the one VRAM is accessible by the system and, thereby, enhances high speed data processing and display of high resolution images on the display with a desirable quality.

The above and other objects, features and advantages of the present invention will become more apparent from the following detailed description taken with the accompanying drawings.

DESCRIPTION OF THE PREFERRED EMBODIMENTS

While the display memory control system of the present invention is susceptible of numerous physical embodiments, depending upon the environment and requirements of use, substantial numbers of the herein shown and described embodiments have been made, tested and used, and all have performed in an eminently satisfactory manner.

Figure 1:
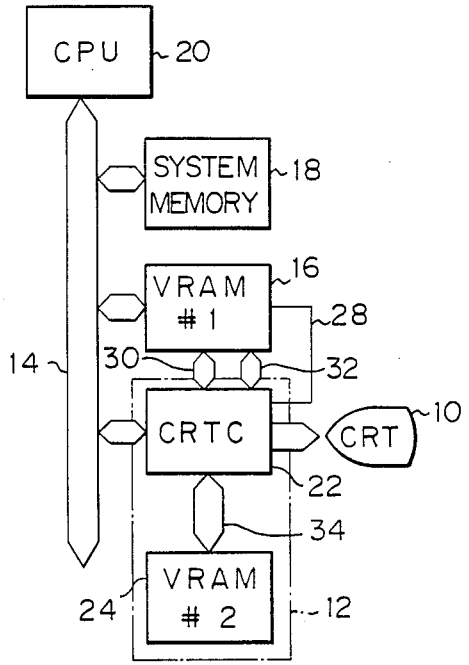
FIG. 1 is a schematic block diagram of a display memory control system embodying the present invention.

Referring to FIG. 1 of the drawings, a system to which a display memory control system of the present invention is applied includes a display unit 10 of the kind needing refreshing, such as a CRT, which is connected to a system bus 14 via a display control unit 12. Also connected to the system bus 14 are a first display memory (VRAM) 16 and a system memory 18. The system bus 14 in turn is connected to a central processing unit (CPU) 20 which serves as a host machine.

Figure 2:
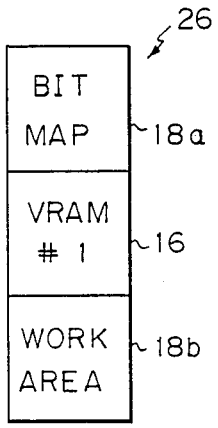
FIG. 2 is a view of a memory map of the system shown in FIG. 1.

As shown, the display control unit 12 comprises a controller (CRTC) 22 and a second VRAM 24. It will therefore be seen that the VRAM 16 is accessible by the CPU 20 and provided with a memory space equivalent to that of the system memory 18 as shown in FIG. 2. The VRAM 16 and the system memory 18 in combination define one memory space 26. Part 16 of the memory space 26 is used as a VRAM #1 and the rest as a bit map 18*a*, a system work area 18*b* and the like necessary for data processing assigned to the CPU 20.

In accordance with the illustrative embodiment, when images are to be displayed on the CRT 10, the CPU 20 writes one frame of display data in the VRAM 16. The display data are transferred to the CRT 10 via the CRTC 22 and, at the same time, to the VRAM 24 to be stored therein. Upon completion of the storage into the VRAM 24, the CRTC 22 reads the display data out of the VRAM 24 to display them on the CRT 10. To update the display data, the CPU 20 makes a write access to the VRAM 16 within a period other than the transfer period from the VRAM 16 to the VRAM 24.

Figure 3:
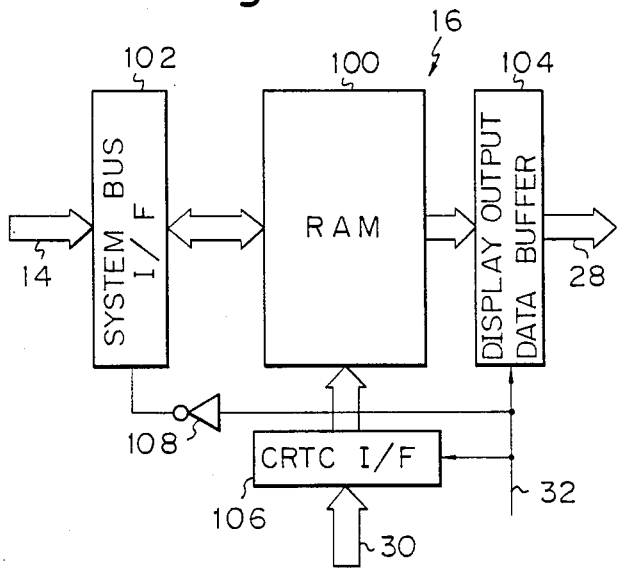
FIGS. 3–6 are block diagrams showing specific examples of various elements included in the embodiment of FIG. 1.

As shown in FIG. 3, the VRAM 16 comprises a RAM 100 for storing one frame of video data, an interface (I/F) 102 to the system bus 14, a display output data buffer (BF) 104, a CRTC I/F 106, and an inverter 108. The VRAM 16 receives addresses, data and control signals over the system bus 14 and in turn applies to the CRTC 22 display video data in bit series or parallel over a data line 28. The CRTC 22 delivers the VRAM 16 addresses, data and control signals over a data line 30 and display control signals over a control line 32.

Both the system bus I/F 102 and the CRTC I/F 106 are applied with only parts of addresses. The parts of addresses are continuously compared with set states of a group of switches (not shown) adapted to set an effective address range of the RAM 100, so that one of the I/Fs which has received an address lying in the effective range is caused to open all of its addresses, data and gate control gates for control signals. This enables the CPU 20 or the CRTC 22 (a video data control section which will be described, labeled 150 in FIG. 5) to develop a bit map on the VRAM #1. In this particular embodiment, the CRTC 22 (video data control section 150) is controlled by the CPU 20 to be free from conflict with the latter concerning and bus and, therefore, an arbitration circuit associated with the I/Fs 102 and 104 is needless.

Figure 4:
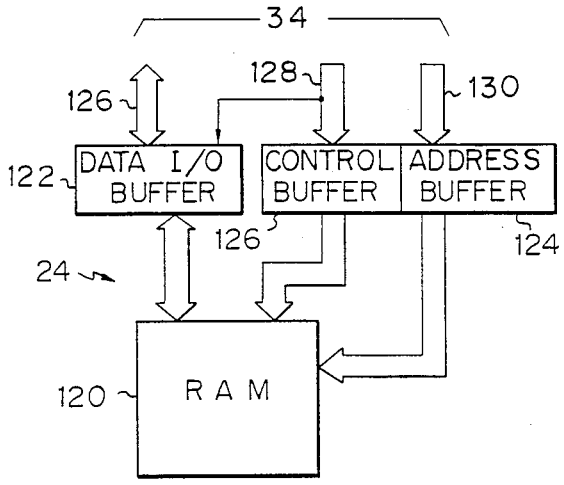

As shown in FIG. 4, the VRAM 24 is made up of a RAM 120 for storing one frame of video data and functioning as a refresh memory, a data input/output buffer 122, an address buffer 124, and a control buffer 126. The VRAM 24 is interfaced to the CRTC 22 by a bus 34 which comprises a data line 126, a control signal line 128 and an address line 130.

Figure 5:
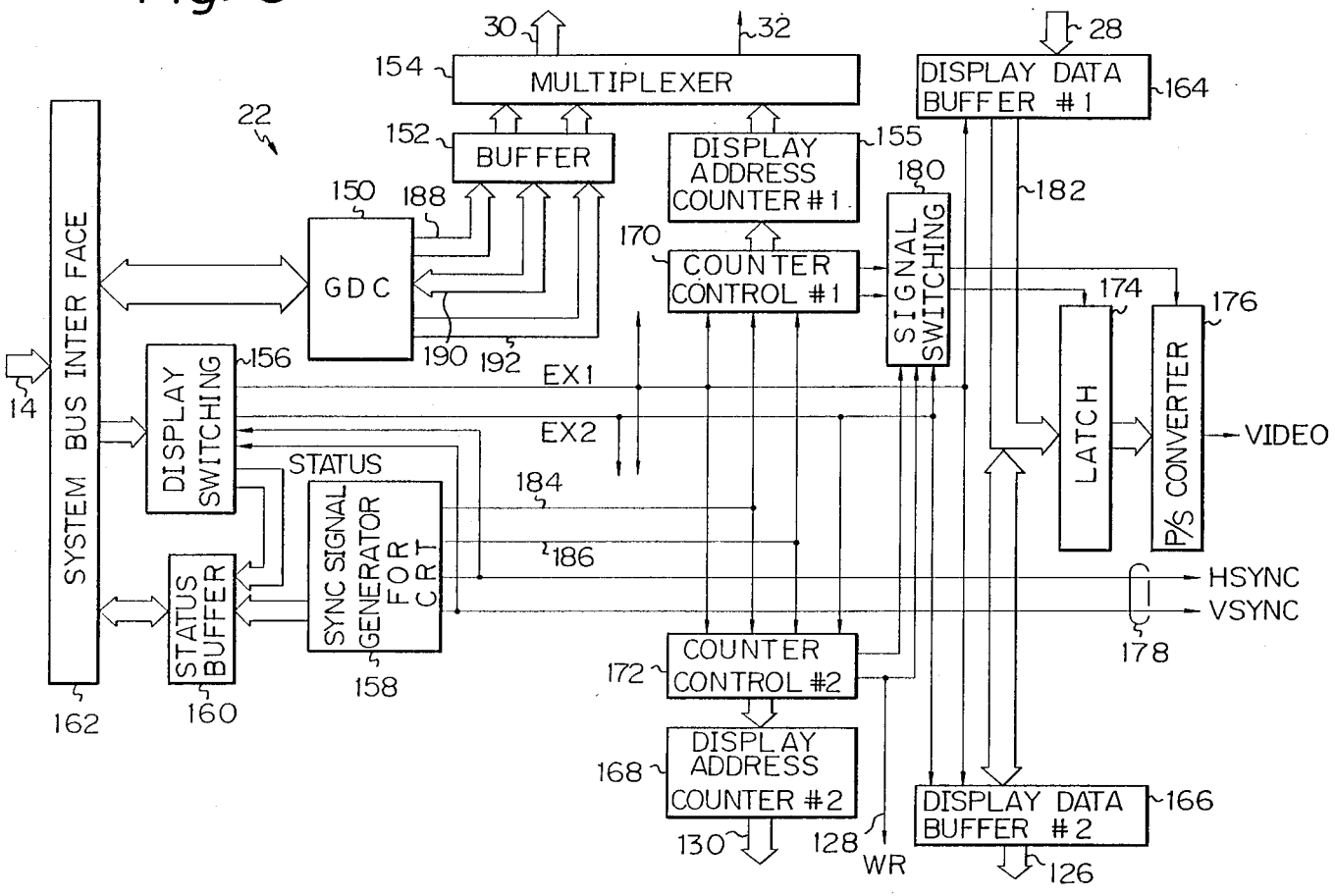

The display controller (CRTC) 22 comprises, as shown in FIG. 5, a graphic data control section (GDC) 150, a buffer 152, a multiplexer 154, a display address counter 155, a display switching circuit 156, a sync signal generator 158 associated with the CRT 10, a status buffer 160, etc. A system bus interface 162 interfaces with CRTC 22 to the system bus 14.

An address from the system bus 14 is applied to the buffer 152 via the GDC 150 over a signal line 188, data over a signal line 190, and a control signal over a signal line 192.

The multiplexer 154 and a display data buffer 164 interface the CRTC 22 to the VRAM 16, while a second display data buffer 166 and a display address counter 168 interface it to the VRAM 24. The address counters 155 and 168 are controlled by counter control sections 170 and 172, respectively.

A video signal VIDEO is delivered to the CRT 10 via a latch 174 and a parallel-to-serial (P/S) converter 176 as illustrated. A horizontal sync signal HSYNC and a vertical sync signal VSYNC are delivered from the sync signal generator 158 over lines 178. The sync signal generator 158 produces a blanking signal on a lead 184 and a dot signal on a lead 186.

Display data from the display data buffers 164 and 166 are selectively routed toward the CRT 10 via a parallel display data bus 182 and this selection is effected by the display switching circuit 156, which executes a display switch command received over the system bus 14. Signal switching at the time of the selection is performed by a signal switching section 180.

Figure 6:
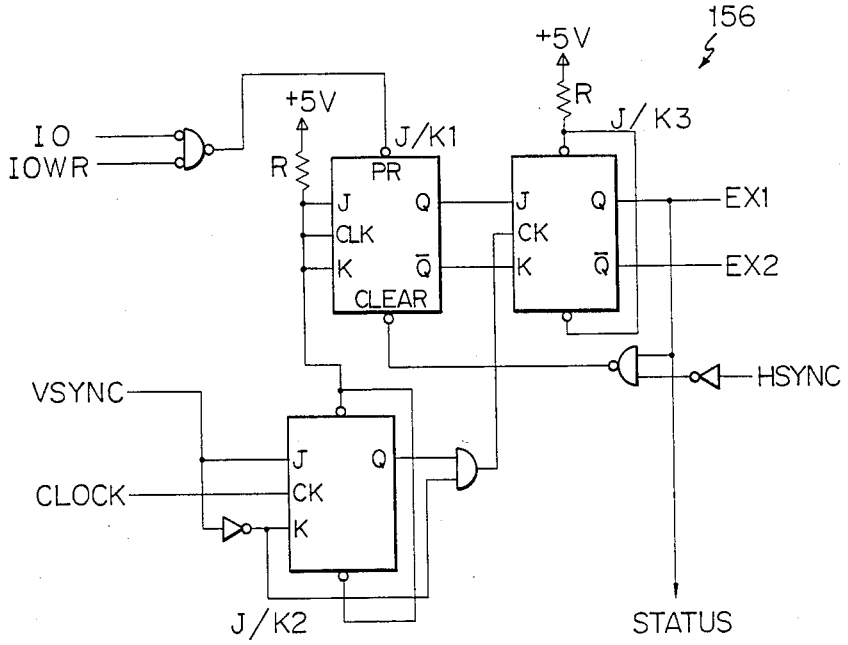

Referring to FIG. 6, the display switching circuit 156 includes three JK flip-flops J/K1, J/K2 and J/K3 which produce switching signals EX1 and EX2 and a status signal STATUS in response to the sync signals HSYNC and VSYNC, an input/output command I0, and a IO write signal IOWR.

In operation, when the CPU 20 has cleared the VRAMs 16 and 24 to their initial states, the CRT 10 displays a content of the VRAM 24. Concerning a system with a high resolution, for example, pulses for causing one dot on the CRT screen to radiate have a frequency higher than about 100 MHz. It is therefore advantageous to, as in the illustrative embodiment, read display data in parallel out of the VRAM 16 or 24 and, then, convert them to a serial VIDEO signal by the P/S converter 176.

For example, in the case where sixty-four bits are to be read out of the VRAM 16 or 24 in parallel, the counter control section 170 or 172 frequency divides the dot pulses to 1/64 and the resulting output is used as an address step signal for the display address counter 155 or 168 and for latching data in the latch 174.

While the delivery of display data from the VRAM 24 to the CRT 10 is under way, the VRAM 16 is free from restriction concerning display and accessible by the CPU 10 any time. The CPU 10 is capable of identifying such a contion by reading a status of the status buffer 160. That is, the status signal STATUS appearing at a Q output of the flip-flop J/K2 (see FIG. 6) as the switching signal EX1 is buffered by the status buffer 160 and read by the CPU 20 via the system bus 14.

In the initial condition, the switching signal EX1 reamins low level. Hence, the CPU 20 reads the signal STATUS from the status buffer 160 as being insignificant and, thereby, decides that the VRAM 16 is accessible. Then, the CPU writes new data to be displayed in the VRAM 16 and, if necessary, sets a parameter in the GDC 150 via the bus 14 to cause it to plot a graph on the CRT screen. Whether or not such a display control has completed is determined by checking the stauts of the GDC 150 itself. In the meantime, the display data are continuously supplied from the VRAM 24.

Figure 7:
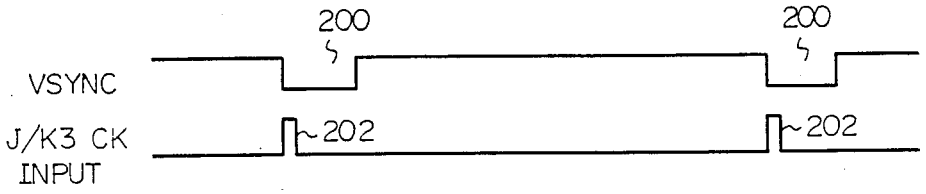
FIG. 7 is a timing chart representative of the operation of the circuit shown in FIG. 6.

In the meantimne, the flip-flop J/K2 is delivering clock 202 to the flip-flop J/K3 in response to the vertical sync signal VSYNC 200 for the CRT (FIG. 7). The flip-flop J/K3, therefore, is generating the switching signal EX1 or EX2 timed to vertical sync by setting the flip-flop J/K1 at every vertical display period, i.e. every frame period.

In the above condition, as the VRAM 16 completes drawing as instructed by the CPU 20, the CPU 20 applies an input/output command IO to the display switching circuit 156. In response to the command IO, the circuit 156 has its flip-flop J/K1 shown in FIG. 6 forcibly set with the result that the signal EX1 becomes significant and the signal EX2, insignificant. The significant signal EX1 enables both the counter control sections 170 and 172 and, thereby, both the display data buffers 164 and 166. Because the signal EX2 is insignificant, the signal switching section 180 regards the command from the counter control section 170 effective and, so, continuously enables the latch 174 and P/S converter 176 while conditioning the display data buffer 166 for an input mode in relation to the VRAM 24.

At this instant, the signal EX1 is transferred to the VRAMs 16 and 24 as a control signal by way of the associated diaplay data buffers 164 and 166. Then, the VRAM 16 renders the system bus I/F 102 and CRTC I/F 106 ineffective and the display output buffer 104 effective, while the VRAM 24 conditions the data input/ouput buffer 122 for an input mode.

The counter control sections 170 and 172 of the CRTC 22. time to each other, supply their associated display address counters 155 and 168 with step pulses at every sixty-four bits. It follows that in the illustrative embodiment the two counters each are incremented at every sixty-four dots of the display.

The contents of the display address counters 155 and 168 are applied to the VRAMs 16 and 24, respectively. Video data in a position associated with a content of the counter 155 is read out of the VRAM and delivered to the latch 174 via the display data buffer 164. The counter control section 170 produces a latch signal whereby the display data are held by the latch 174. The display data are then converted by the P/S converter 176 to a serial signal which is then applied to the CRT 10 timed to the dot signal on the lead 186 as the video signal indicative of pixels to be displayed.

The display data applied from the buffer 164 to the data bus 182 are also routed to the VRAM 24 via the display data buffer 166. The counter control section 172 applies a latch signal to the control line 128 as a write signal WR in response to which the display data on the data bus 182 are written in the RAM 120 of the VRAM 24.

In the above-described manner, when sixty-four dots of pixel data have been read out of the VRAM 16, a step pulse is applied to the address counters 155 and 168 designate the next store positions of the VRAMs 16 and 24. By such a procedure, one frame of display data stored in the VRAM 16 are sequentially transferred to and displayed on the CRT 10 and, at the same time, transferred to the VRAM 24 to be stored therein.

Meanwhile, the flip-flop J/K1 set at the start of read-out from the VRAM 16 is reset upon completion of read-out of one horizontal scanning line of data. Then, as soon as one frame of data have been fully displayed, the flip-flop J/K2 is set to switch the flip-flop J/K3 so that switching signal EX1 becomes insiginificant and the switching signal EX2, significant. This establishes the same condition as the previously mentioned initial condition, in which the VRAM 16 renders the display data output buffer 104 ineffective to inhibit reading of data thereoutof. Simultaneously, the VRAM 16 renders the system bus interface 102 and CRTC I/F 106 and, therefore, accesses thereto by the CPU 20 effective.

The significant signal EX2 turns the display data buffer 166 to an output mode and the signal switching section 180 regards the signal from the counter control section 172 effective. This causes the display signal stored in the VRAM 24 to be read out and transferred via the latch 174 and P/S converter 176 to the CRT 10 and displayed thereon. As previously discussed, the current content of the VRAM 24 is a copy of the previous content of the VRAM 16 so that the display on the CRT 10 remains unchanged despite the switching operation.

In this manner, the CPUT 20 in the event of displaying a picture on the CRT 10 writes one frame of display data in the VRAM 16. Such data are transferred to and displayed on the CRT 10 via the CRTC 22 and, at the same time, transferred to and stored in the VRAM 24. As the storage of the data into the VRAM 24 is completed, the CRTC 22 reads the display data out of the VRAM 24 to display them on the CRT 10. For updating the display data which will follow, the CPU 20 makes a write access to the VRAM 16 within a period other than the transfer period from the VRAM 16 to the VRAM 24. Concerning the VRAM 16, it may be rewritten oer one whole frame or part thereof as desired and, therefore, the time necessary for rewriting is not constant.

In the construction shown in FIG. 5, the address counter 155 and counter control section 170 are assigned exclusively to the VRAM 16 and the address counter 168 and counter control section 172 exclusively to the VRAM 24. Alternatively, for a simpler circuit arrangement, the VRAMs 16 and 24 may share a single set of address counter and counter control section, in which case addresses will be delivered through their associated buffers switched by the switching signals EX1 and EX2.

In the above-described embodiment, because one frame of display data are transferred from the VRAM 16 to the CRT 10 and VRAM 24, the CPU 20 cannot access the VRAM 16 over the fixed transfer period. Another embodiment of the present invention which eliminates such inconvenience will be described with reference to FIGS. 8–14. In FIGS. 8–14, the same or similar structural elements as those of the first embodiment will be designated by like referece numerals and detailed description thereof will be omitted for simplicity.

Figure 9:
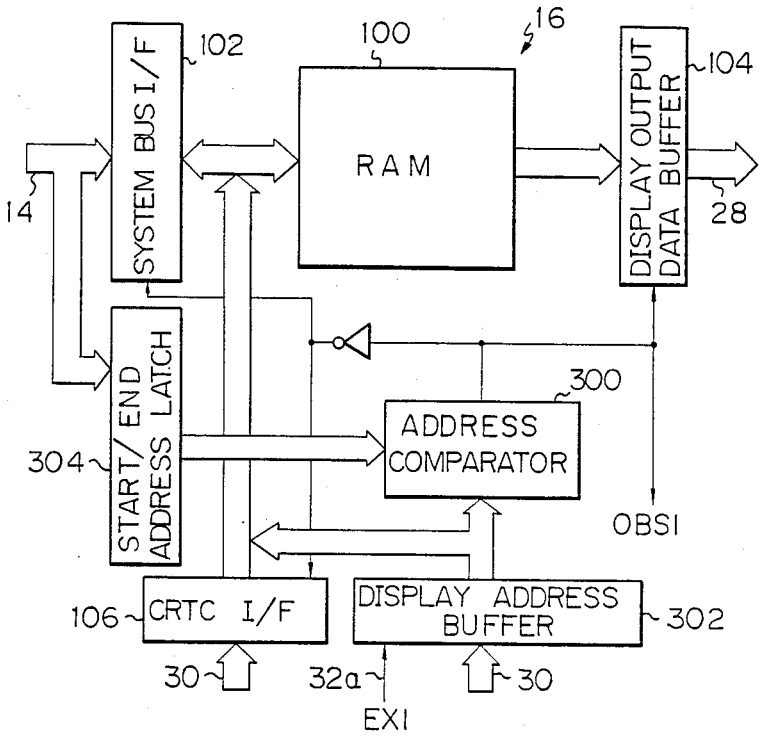
FIGS. 9–12 are block diagrams showing specific examples of elements which are included in another embodiment of the present invention.
Figure 10:
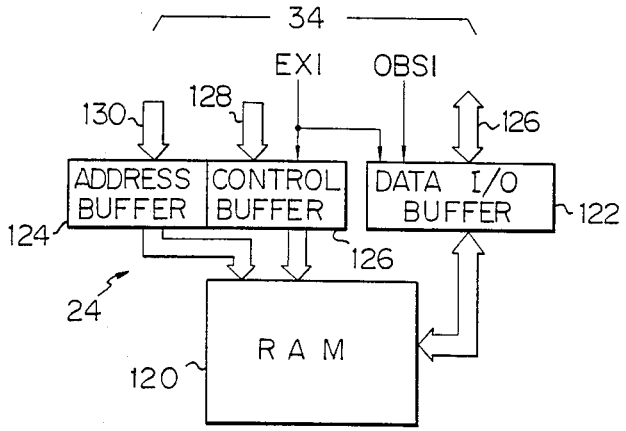
Figure 11:
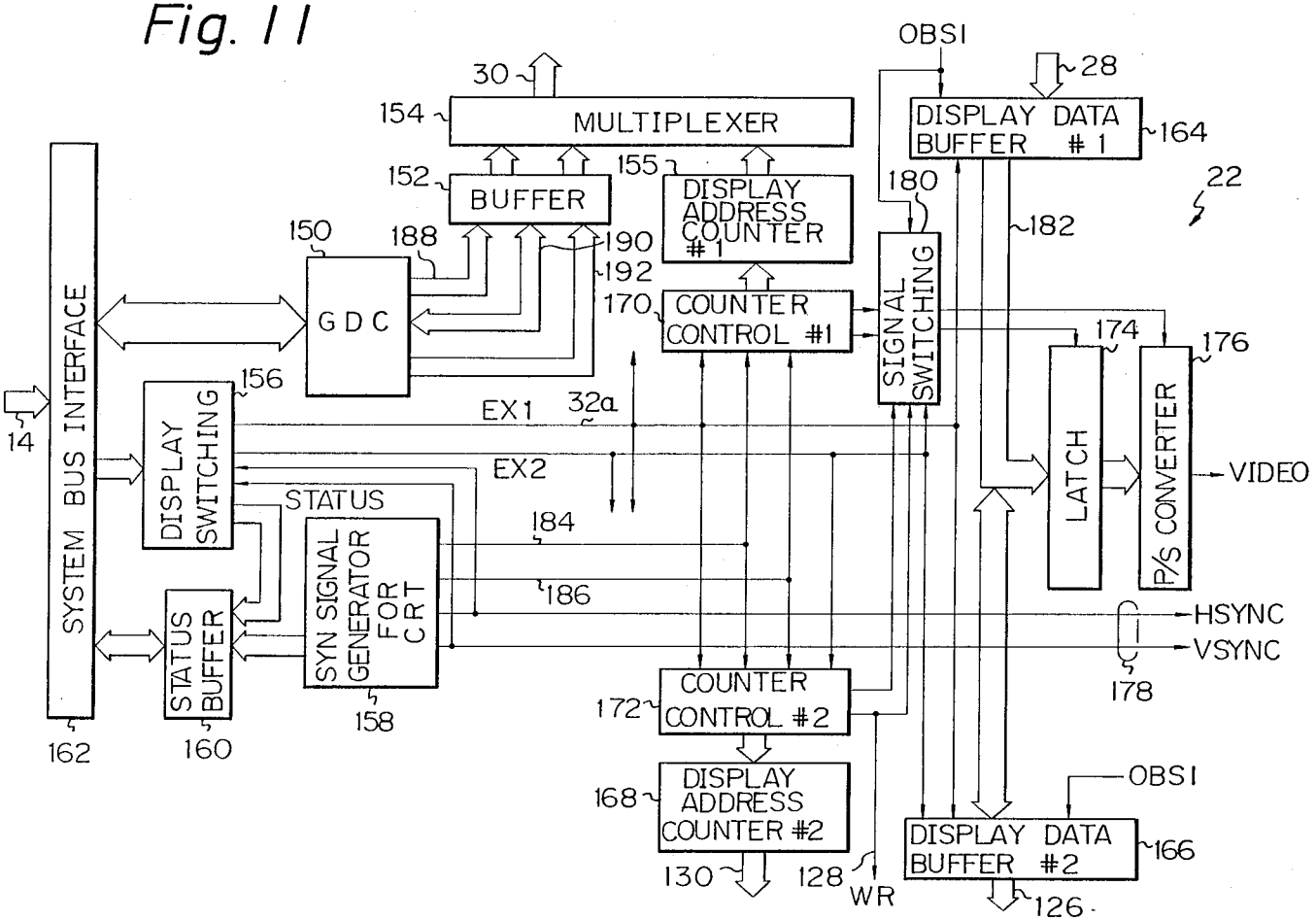

As shown in FIG. 9, the VRAM 16 comprises an address comparator circuit 300, a display address buffer 302 and a start/end address latch 304. A signal OBS1 representative of a result of comparison output from the comparator circuit 300 is delivered to various sections of the system and, therefore, the system opertion is somewhat different from that of the first embodiment. The signal OBS1 is routed to the data input/output buffer 122 of the VRAM 24 as shown in FIG. 10 and, also, to the display data buffers 164 and 166 and signal switching section 180 as shown in FIG. 11.

Figure 12:
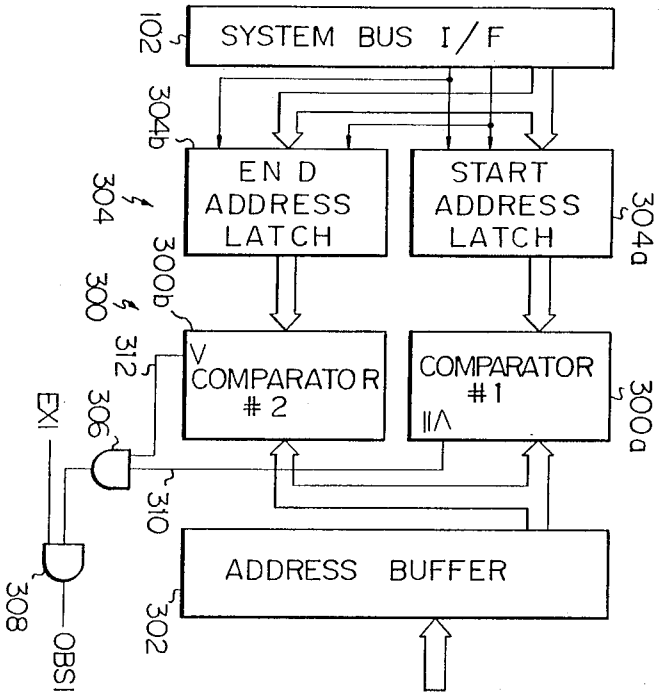

As shown in detail in FIG. 12, the address comparator circuit 300 is made up of two comparators **300*a* and 300*b* and two AND gates 306 and 308. The comparator 300*a* is adapted to render a lead 310 high level when an address applied thereto from an address buffer 302 does not exceed a start address applied from the system bus 14 via a start address latch 304*a*. The comparator 300*b*, on the other hand, is adapted to render a lead 312 high level when an address from the address buffer 302 is smaller than an end address applied from the system bus 14 via an end address latch 304*b***.

In an initial condition, the switching signal EX2 is significant and, in the VRAM 16, the system bus I/V 102 and CRTC I/F 106 are effective to maintain the the VRAM 16 accessible by the CPU 20. Because the VRAM 16 is in a display data output mode, its content is displayed on the CRT 10.

Figure 8:
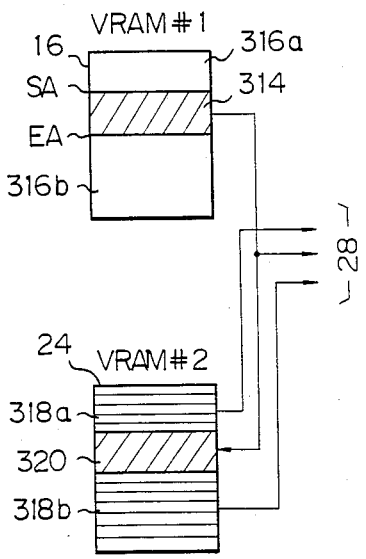
FIG. 8 shows a manner of display data output in accordance with another embodiment of the present invention.

Assume that the CPU 20, as shown in FIG. 8, has updated only limited part of one frame, i.e., hatched part 314. Specifically, let it be assumed that the CPU 20 has updated video data over a certain region 314 whose area is an integral multiple of one horizontal scanning line in the frame, while maintaining the other regions **316*a* and 316*b*** unchanged.

Then, the first embodiment would transfer one frame of display data from the VRAM 16 to the CRT 10 and VRAM 24 despite the partial change of the display data, that is, it would develop a copy of one frame of display data in the VRAM 24 despite the partial change of the display data. In contrast, in accordance with the second embodiment, only the region 314 updated anew is transferred.

In detail, as shown in FIG. 8, in the event of delivery of the updated display data to the CRT 10, the other or non-updated display data are displayed by reading the display data out of the store regions **318*a* and 318*b* of the VRAM 24 and transferring them to the CRT 10. Concerning the updated part of the display data, it is read out of the store region 314 of the VRAM 16 and transferred to the CRT 10 to be displayed and, at the same time, transferred to the VRAM 24 to be stored in a store region 320 associated therewith. This displays the new image on the CRT 10 and updates the content of the VRAM 24 at the same time and, in addition, shortens the time necessary for writing the specific display data in the store region 320 by an amount complementary to the dimensions of the region 320**, compared to the first embodiment.

After the CPU 20 has completed the video data processing on the VRAM 16, that is, after the display data in the region 314 have been fully updated, the CPU 20 transfers a start address SA associated with the region 314 to a start address latch **304*a* and an end address EA to an end address latch 304*b*. Then, the CPU 20 delivers a display switch command to the display switching circuit 156 which then renders the signal EX1 significant. In response to the significant signal EX1, the counter control sections 170 and 172 individually generate count pulses timed to the signal VSYNC so that their associated display address counters 155 and 168** start counting the pulses.

The comparator **300*a* in the VRAM 16 compares an address applied thereto from the display address counter 155 with the start address SA held in the start address latch 304*a*, while a comparator 300*b* compares it with the end address EA held in the end address latch 304*b***.

While the stored data in the region **318*a* is read out of the VRAM 24 and displayed on the CRT 10, an output 310 of the comparator 300*a* remains low level to maintain the signal OBS1 low level. In this condition, the display data buffer 164 is not enabled so theat no display data from the VRAM 182 appears on the data bus 182. The VRAM 24, on the other hand, is conditioned for a data read and output mode as in the case with the significant EX2, whereby the display data are read out of the VRAM 24 to be displayed on the CRT 10. In the meantime, the CPUT 20 is capable of accessing the VRAM 16 because the system bus interface 102 and CRTC I/V of the VRAM 16** have been made effective by the low level signal OBS1.

The address counters 155 and 168 are incremented to cause the display data in the region **318*a* to be read out sequentially in the order of raster scan. As the contents of the address counters 155 and 168 equal each with the start address SA of the specific region 314, the output 310 of the comparator 300*a* turns itself to high level and, due to the high level of the output 312 of the comparator 300*b***, turns the signal OBS1 to high level.

The signal OBS1 now high level enables the display data buffer 164 and sets the data input/output buffer 122 of the VRAM 24 to a write mode. Then, the data stored in the region 314 of the VRAM 16 are sequentially read out and transferred to the CRT 10 to be displayed thereon, while being transferred to the VRAM 24 to be sequentially written in the region 320. In this manner, the display data fromm the head address SA to the tail address EA are displayed and, at the same, their copy is developed in the region 320.

The high level signal OBS1 renders the system bus interface 102 and CRTC I/F of the VRAM 16 ineffective so that the CPU 20 is not allowed to make access to the VRAM 16 any more.

As the address counters 155 and 168 are further incremented to coincide each with the end address EA of the region 314, the output 312 of the comparator **300*b* becomes low level to in turn make the signal OBS1 low level. At this instant, the VRAM 24 comes to share the same content with the VRAM 16, meaning that a copy associated with the whole frame has been reproduced in the VRAM 24. The subsequent control occurs in the same manner as one which occurred during the display of the data stored in the region 318*a*; the display data stored in the region 318*b* are sequentially read out of the VRAM 24 to be displayed on the CRT 10**.

As soon as the display data on the last line in the region **318*b* of the VRAM 24 is displayed, the display switching circuit 156 renders the signal EX1 insignificant and the signal EX2 significant as in the first embodiment, thereby turning the signal OBS1 low level. At this instant, the low level signal OBS1 makes the system bus interface 102 and CRTC I/F 106 of the VRAM 16 effective to thereby make the VRAM 16 accessible by the VRAM 16. Thereafter, the display data are sequentially read out of the whole area of the VRAM 24 to be transferred to the CRT 10**.

As described above, in accordance with the second embodiment, the access by the CPU 20 to the VRAM 16 is inhibited only for a period wherein display data are sequentially read out of the region 314 of the VRAM 16 and transferred to the CRT 10. This offers the CPU 20 a longer period of time within which it can make access to the VRAM 16 than in the case of the first embodiment.

Figure 14:
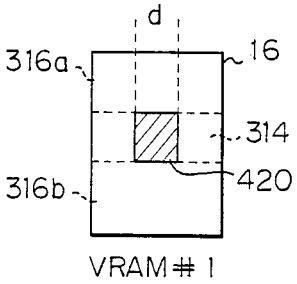
FIG. 14 shows a manner of updating a dislay memory associated with the construction of FIG. 13.

As shown in FIG. 14, where it is desired to update only part of the region 314 of the VRAM 16, i.e., part 420 with a bit width d, only the data in the desired part 420 may be read out of the VRAM 16 and transferred to the CRT 10 while being written in an associated region of the VRAM 24. Such may be implemented by adding an address comparator circuit 400 shown in FIG. 13 to the arrangement of the second embodiment.

Figure 13:
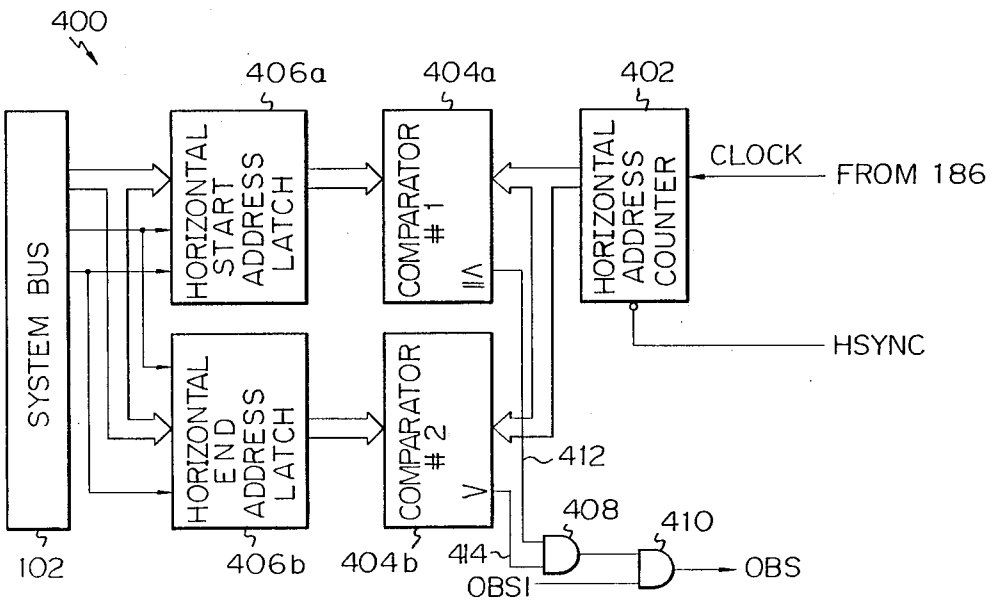
FIG. 13 is a block diagram of an example of a horizontal address comparator circuit in accordance with still another embodiment of the present invention.

The circuit shown in FIG. 13 represents a horizontal direction address comparator circuit constructed to compare addresses, or dot positions, in the horizontal direction. As shown, the comparator circuit 400 comprises a horizontal address counter 402 for counting dot signals produced from the sync signal generator 158 on the lead 186 and reset by the signal HSYNC, two comparators **404*a* and 404*b*, a horizontal start address latch 406*a*, a horizontal end address latch 406*b*, and two AND gates 408 and 410**.

The comparator **404*a* turns a lead 412 to high level when an address output from the address counter 402 does not exceed a horizontal start address which is applied thereto from the system bus 14 via the start address latch 406*a*. The comparator 404*b*, on the other hand, makes a lead 414 high level when an address from the address counter 402 is smaller than a horizontal end address applied thereto from the system bus 14 via the end address latch 406*b***.

Instead of the signal OBS1, a signal OBS produced in the above-described manner is used to control the display data buffers 164 and 166. As seen from the foregoing description, addresses are compared also in the horizontal direction of the picture frame so that only the display data in the particular region 420 which the CPU 20 updated is read out of the VRAM 16 and displayed on the CRT 10 and, at the same time, its copy is reproduced in the VRAM 24. The access to the VRAM 16 by the CPU 20 is inhibited only during that period, thereby increasing accessible time to the VRAM 16.

While the embodiments of the present invention have been shown and described in relation with the delivery of video data to a display unit, the concept of the present invention is effectively applicable even to a hard copy producing device such as a printer.

In summary, it will be seen that the present invention provides a display memory control system which offers an unprecedented period of time within which one of two VRAMS is accessible by a high resolution images to appear on a display with a desirable quality.

Various modifications will become possible for those skilled in the art after receiving the teachings of the present disclosure without departing from the scope thereof.

What is claimed is:

1. A display memory control system for the display of images in response to commands of a host machine comprising:

a first display memory means connected to said host machine for storing display data from said host machine;

control means coupled to said host machine and said first display memory means for controlling a display unit, said control means comprising:

a second display memory means contained within said control mans for storing display data from said host machine;

first transfer means contained within said control means for transferring in response to a display signal from said host machine display data stored in said first display memory means to said display unit;

second transfer means separate from said first transfer means and contained within said control means for transferring at least some of the display data stored in said first display memory means to said second display memory means in response to the same display signal that said first transfer means is responsive to;

inhibition means coupled to said host machine for inhibiting the access of said host machine to said first display memory means during the operation of said first and second transfer means;

means for sensing the commencement and completion of data transfer into said second display memory means;

coupling means for coupling said secpond display memory means the data stored therein to said display unit responsive to the completion of data transfer into said second display memory means by said second transfer means; and wherein the transition time for transferring data from the first display memory means to the second display memory means is faster than the display cycle.

2. A display memory control system as in claim 2, wherein the dta that is transferred from said first memory means is transferred by said second transfer means in response to the completion of data transfer into said second display memory means.

3. A display memory control system as in claim 1, further comprising: determining means for determining which data has changed in said first memory means and wherein only that data which has changed within said first memory means is transferred to said second memory means by said second transfer means in response to the completion of data transfer of data into said second display memory means.

4. A display memory control system as in claim 3, wherein the data that is transferred by said second transfer means, and display data in parts other than said second data memory means are transferred by said coupling means to said second display memory means responsive to the completion of transfer by said second transfer means.

5. A display memory control system for the display of images in response to commands of a host machine in response to an operator's instruction, comprising:

first memory means connected to said host machine for storing display data from said host machine;

control means coupled to said host machine and said first memory means for controlling a display unit, said control means comprising;

second memory means for storing display data from said first memory means;

first and second transfer means wherein said second transfer means is for transferring the display data stored in said first memory means to said second memory means immediately after the completion of data transfer from said host machine; and wherein said first transfer means is for transferring synchronously with transferring of said second transfer means the same display data stored in said first memory means to said display unit;

means for sensing the commencement and completion of data transfer into said second display memory means;

inhibition means coupled to said host machine for inhibiting the access of said host machine to said first memory means during the operation of said second transfer means;

display transfer means for transferring the display data stored in said second memory means to said display unit from immediately after the completion of data transfer by said second transfer means till the commencement of the next data transfer by said first transfer means and wherein the transition time for transferring data from the first display memory means to the second display memory means is faster than the display cycle.

6. A display memory control system for the display of images in response to commands of a host machine in response to an operator's instruction comprising:

first memory means connected to said host machine for storing display data from said host machine;

control means coupled to aid host machine and said first memory means for controlling a display unit, said control means comprising:

second memory means for storing display data from said first memory means;

determining means for determining which data has changed in said first memory means;

first and second transfer means wherein said second transfer means is for transferring only display data which has changed within said first memory means to said second memory means immediately after the completion of data transfer from said host machine; and wherein said first transfer means is for transferring synchronously with transferring of said second transfer means the same display data which has changed within said first memory means to said display unit;

means for sensing the commencement and completion of data transfer into said second display memory means;

inhibition means coupled to said host machine for inhibiting the access of said host machine to said first memory means during the operation of said second transfer means;

display transfer means for transferring the other data of said only display data from said second memory means to said display unit from immediately after the completion of data transfer from said host machine and said only display data from said second memory means to said display unit from immediately after the completion of data transfer by said second transfer means, until the commencement of the next data transfer by said first transfer means and wherein the transition time for transferring data from the first display memory means to the second display memory means is faster than the display cycle.

* * * * *